United States Patent [19]

McKeen, Jr.

[11] 4,030,151

[45] June 21, 1977

[54] TOW STRAP FOR PNEUMATIC INNER TUBE

[76] Inventor: Edwin E. McKeen, Jr., E. 112 Regina, Spokane, Wash. 99218

[22] Filed: May 19, 1976

[21] Appl. No.: 688,062

[52] U.S. Cl. ..... 9/1.7; 9/1.3; 9/340

[51] Int. Cl.[2] ..... B63C 9/08

[58] Field of Search ..... 9/1.3, 1.7, 2 A, 310 R, 9/310 B, 310 C, 310 F, 310 G, 311, 329, 336, 337, 340, 347; 114/235 R, 235 US; 115/6, 6.1; 280/12 B

[56] References Cited

UNITED STATES PATENTS

| | | | |
|---|---|---|---|
| 1,764,852 | 6/1930 | Phillips | 9/347 |
| 1,832,998 | 11/1931 | Rentos | 9/336 |
| 3,074,084 | 1/1963 | Bisch | 9/347 |
| 3,581,328 | 6/1971 | Smith | 9/310 G |
| 3,748,672 | 7/1973 | Patrick et al. | 9/347 |

FOREIGN PATENTS OR APPLICATIONS

| | | | |
|---|---|---|---|
| 634,417 | 2/1928 | France | 9/347 |

*Primary Examiner*—George E. A. Halvosa
*Assistant Examiner*—Stuart M. Goldstein

[57] ABSTRACT

A strap type device releasably fastenable about an annular section of an pneumatic tire inner tube to aid towage thereof, particularly over a water surface. The strap provides a handle to aid a user in maintaining position on the inner tube and to act cooperatively with a depending rudder carried by the lower portion of the strap to provide some degree of steerage.

3 Claims, 5 Drawing Figures

FIG. 1
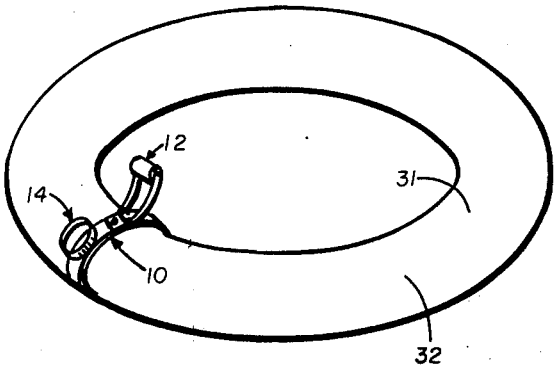
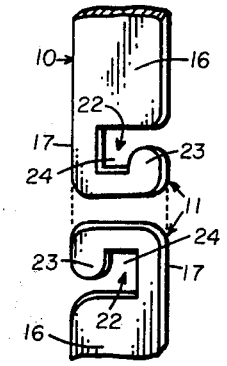
FIG. 5
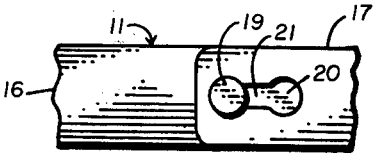
FIG. 4
FIG. 2
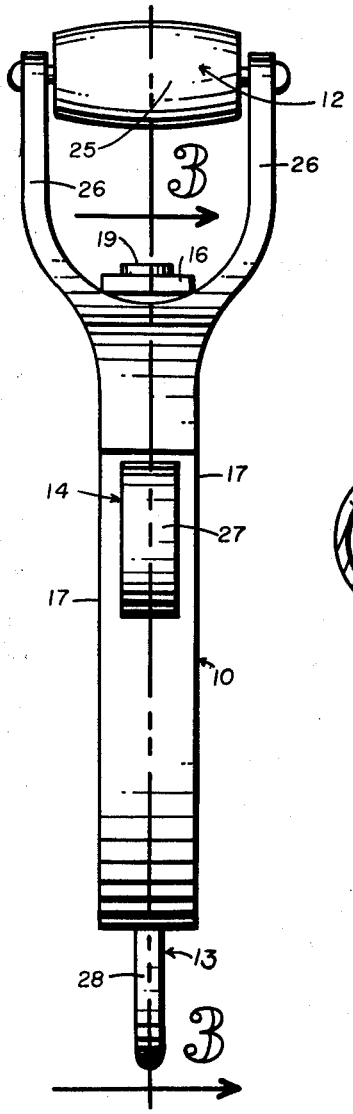
FIG. 3
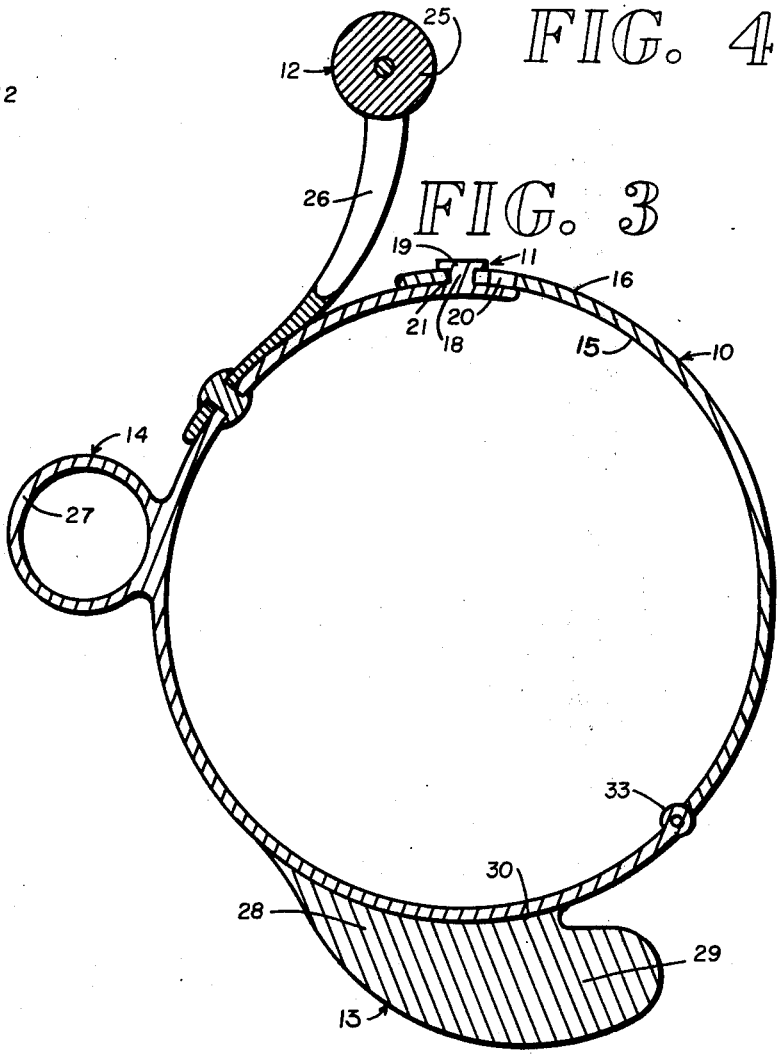

TOW STRAP FOR PNEUMATIC INNER TUBE

BACKGROUND OF INVENTION

RELATED APPLICATIONS

There are no applications related hereto now filed in this or any foreign country.

FIELD OF INVENTION

This invention relates generally to a device to interconnect a tow rope to an inflated inner tube and more particularly to such a device that provides gripping means and aids steerage.

DESCRIPTION OF THE PRIOR ART

Pneumatically inflated inner tubes have heretofore feen used as a supportative type vehicle, especially on water or solid surfaces upon which they create little moving friction, such as ice or snow. For such uses the inner tube may be combined with auxiliary structures such as runners, skis or the like that support it on a surface or may be directly supported on a surface over which it is to move, as in the case of water or loose snow. In the recent past inner tubes have become popular for use as a recreational vehicle of sorts to support a user while towed behind a boat. The instant invention is concerned particularly with this usage of pneumatic inner tubes and provides a particular harness therefore.

To aid analysis of the prior art, it may conveniently be divided into a first category of inner tube vehicles having auxiliary structures that support the tube on an underlying surface over which it is to move, and a second class comprising vehicles providing support of the inner tube per se directly upon an underlying surface. The first class of devices generally provides runners, wheels, skis or sleds of some sort to support the inner tube. The members of this group are readily distinguished in both structure and function from those of the second group because of this difference in manner of support on a supportative surface. The structure necessitates support by the inner tube of the structure that ultimately communicates with a supportative surface and this entails a complex and generally massive and costly construction.

My invention is a member of the second class of devices. The devices of this class generally have provided some auxiliary structure associated with an inner tube to adapt it for some specialized use and the auxiliary structures involved have been necessarily and essentially related to that use and generally have been quite complex and costly. In one instance the inner tube has been used as the body for a diving device, in another instance as a flotation for a rigid platform upon which a user may position himself in various fashions; and in yet another as a bouyancy collar for a raft. All of this art is distinguished from the instant invention in both structure and necessarily related function. The instant invention is small and compact. It provides no platforms or other bulky structures for user support, but rather allows the user to be supported directly upon the tube itself. This is done primarily for safety as when inner tubes are towed their course of travel, even with some means of steerage, it is at best erratic and often times unstable; this, of course, gives rise to desirability as a recreational vehicle but on the other hand makes the vehicle dangerous if it have any massive or sharp structures that might strike a user, particularly after a user has been thrown from normal positioning on the vehicle. This relatively small, compact nature which increases safety also makes my device simple of use and economic of manufacture. My device further provides a fastening means for a tow rope that is very close, vertically, to the water so that the angle of the tow rope will normally be upwardly toward the towing vehicle to aid in maintaining flotation of a towed inner tube as opposed to prior art devices that fasten a tow rope at a high point to create a bias tending to cause the inner tube to dive under the surface of supporting water. My device is further distinguished in that it provides a handle which aids a user to maintain a position on the inner tube and also provides a rudder depending from the device to aid in maintaining some stability of linear motion and in combination with the handle to provide some limited means of steerage during motion. None of the prior art is found to have all of these elements in combination to fulfill the same functions as the instant invention, though obviously some of the individual features are known per se.

SUMMARY OF INVENTION

My invention provides generally a semi-flexible strap-like body for releasable fastening about an annular segment of a pneumatic inner tube by manually manipuable fastening means associated with the ends of the body. The body carries a rudder in its lower medial part and a handle structure and a tow rope fastening device in its foreward part. These latter structures are normally positioned on the body so that the tow rope fastening structure is by radial measurement approximately 90° away from the rudder and the handle and end parts of the strap-like body slightly further radially distant in the same direction, so that if the device be positioned on an inner tube with the rudder depending downwardly therefrom, the tow rope fastening structure will be pointing substantially forwardly and the handle structure will be slightly thereabove.

In providing such a device it is:

A principal object of my invention to create a simple, light weight tow strap for a pneumatic inner tube that is of new and novel design, of rugged and durable nature, and of simple and economic manufacture.

A further object of my invention is to provide such a device that has a depending rudder to aid in maintaining stability of linear motion of the tube when towed over a supportative water surface.

A further object of my invention to provide such a device that has a handle to aid a user in maintaining a supportative position upon the inner tube during transit and in combination with the rudder to allow some means of limited steerage relative to the direction of tow during the course of motion of an inner tube serviced by the device.

Other and further objects of my invention will appear from the following specification. In carrying out the objects of my invention, however, it is to be understood that its features are susceptible of change in design and structural arrangement with only one preferred and practical embodiment being illustrated as required.

BRIEF DESCRIPTION OF DRAWINGS

In the accompanying drawings which form a part of this specification and wherein like numbers of reference refer to similar parts throughout:

FIG. 1 is an isometric view of my invention in operative position upon a typical pneumatic inner tube of commerce.

FIG. 2 is an orthographic front view of the device illustrated in FIG. 1 showing its various parts, their configuration and relationship.

FIG. 3 is an orthographic cross-sectional view of the device of FIG. 2, taken on the line 3—3 of that Figure in the direction indicated by the arrows, to show its various features from this aspect.

FIG. 4 is a partial orthographic view of the principal headed buttonkeyed slot means of fastening the ends of the body together.

FIG. 5 is a partial detailed view of a species showing a hook and slot means of releasably fastening the ends of the body strap of my invention together.

DESCRIPTION OF THE PREFERRED EMBODIMENT

My invention comprises generally strap-like body 10 having fastening means 11 for releasable attachment of its ends to each other and about an annular section of a pneumatic tube, with handle 12 and tow line fastening means 14 immediately adjacent the ends of body 10 and rudder 13 depending therefrom.

Body 10 is an elongate strap-like member, as illustrated particularly in FIGS. 3 and 4, generally with greater width than thickness and a length appropriate to extend in a nice fit about an annular section of a pneumatic inner tube to be serviced. This band provides inner surface 15 and outer surfaces 16 with side edges 17. Preferably the joinder of these surfaces with each other is somewhat curvilinear so that the structure provides no sharp edges or irregular protuberances which might more probably puncture an inner tube to be serviced than would such a smooth edge structure. The body is formed of some reasonably strong, resiliently flexible material of appropriate strength, preferably a metal, such as a relatively thin spring steel. The body may be formed in one piece or, if desired, for ease of placement or if necessitated by material rigidity or method of manufacture, may be formed with two pieces interconnected by pin hinge 33 as illustrated in the drawings. Other materials such as aluminum or semi-rigid, resilient plastics, especially accrylic polymers, will also serve the purposes of my invention, if not so well. Preferably, because of the water environs in which my tow strap commonly is placed, it should either be formed of corrosion resistant material or should be covered with some corrosion resistant covering, all according to principles well known in the existing art.

The end parts of body 10 provide cooperating fastening means 11 by which the ends may be releasably interconnected. In the primary specie of my invention shown particularly in FIG. 3, this fastening means provides the headed button-keyed slot fastener there illustrated. The button is fastened by its smaller elongate shaft 18 to one end part of the body 10 immediately inwardly adjacent that end and structurally mounts larger button head 19, normally of a substantially circular peripheral shape, at its outwardly projecting end. The length of shaft 18 is slightly greater than the thickness of body 10. The cooperating keyed slot defined in the body immediately inwardly adjacent the opposite end of the body, with enlarged placement hole 20, most distal from the nearest body end, communicating with narrower fastening channel 21 extending toward the nearest body end away from the placement hole. Placement hole 20 is slightly larger than button head 19 so that the head may easily pass therethrough and fastening channel 21 is slightly larger than button shaft 18 but smaller than button head 19 so that when the button is placed through the placement hole the button shaft may move into the fastening channel to releasably fasten the two ends together. To properly accomplish and maintain this fastening, the length of body 10 between fastening button and fastening slot is such that when the body is fastened there will be some elastic force baused by the engirdle dinner tube tending to bias the fastening device to a fastened condition but not so much force that it cannot be overcome fairly readily in manually manipulating the fastening means.

Fastening means 11, in essence, requires only some releasable method of fastening the two ends of body 10 to each other and may be accomplished by many known means other than that illustrated. A secondary species of fastening structure is shown in the somewhat enlarged partial view of FIG. 5, where there is formed in each end of body 10 L shaped slots 22 of such configuration that hook portions 23 of either end will fit, somewhat snugly, through body 24 of the slot defined in the opposite end. This type of fastening device is well known in the prior art and may be accomplished by configuration of parts substantially as illustrated in FIG. 4. When the two ends of the body are fastened by this means they will be slightly skewed relative to each other and this skewedness, when aided by the pneumatic resilience of an encircled inner tube, and appropriate body dimensions as aforesaid, will tend to bias the fastening device to a fastened position and tend to avoid accidental dislodgment. A plurality of other fastening means might serve the same purpose of my invention.

Handle 12 comprises medial grasping portion 25 structurally carried between the end parts of the opposed cooperating legs of Y shaped handle yoke 26 which in turn is structurally carried by body 10 preferably near one of the ends of that body as illustrated. Preferably the handle carrying end will be the end that is lowermost in the illustration of FIG. 1, so that the body will be continuous between handle and rudder, and though this is desirable it is not necessary to my invention. For convenience again, the handle is preferably carried by the body immediately inwardly of the fastening means of the body end closest to the handle and there mechanically fastened to the body. Preferably yoke 26 is formed of metal similar to the body to provide appropriate strength and if so, the mechanical joinder may readily be accomplished by welding, riveting or similar known means. Normally the medial grasping portion 25 of the handle will be formed from some material and of a configuration that is readily grasped such as wood or plastic in the form illustrated - a cylinder of revolution having an enlarged middle portion.

Tow line fastening structure 14 comprises fastening loop 27 mechanically joined to body 10, preferably inwardly adjacent (with reference to the nearest body end) the joinder of body 10 and handle 12. The loop is preferably though not necessarily, formed with a closed periphery, from metal and may be conveniently joined to the body by normal mechanical joining means such as spot welding or riveting. If desired, in particular manufacture, the loop may be formed unitarily with body 10.

Rudder 13 is a thin sheet-like element formed with some substantial areal cross-section in a configuration somewhat as illustrated, particularly in FIG. 2. Obviously the exact areal configuration is not essential to service of the element as a rudder. The rudder is of a width only sufficient to provide reasonable rigidity and its length, parallel to a diameter of the body, is of approximately 1/16 of the length of the body. The rudder provides a forward somewhat shorter portion 28 (measured normally somewhat to the body) and a rearward longer portion 29 to give it greater steerage potentially because of the lever arms and forces involved. Inner or body facting edge 30 is shaped substantially to the configuration assumed by body 10 when positionally maintained on an inner tube to be serviced, and this inner surface 30 is joined to the body by appropriate mechanical fastening by means known in the art. If rudder is be formed of metal this joinder may be accomplished by welding, riveting or the like and if formed of a rigid non-metallic material such as plastic, by adhesion, tensioning or some similar known method. Since it is possible that a user may fall an inner tube and the tube may thereafter erratically gyrate, it is possible that a user could be struck by this rudder and because of this, my invention is safer if the rudder be formed of some reasonably resilient material such as softer plastic or hard rubber, though again this is a preference and not necessary to the essence of my invention.

The radial arrangement of handle, fastening loop, rudder and body ends is preferably substantially as illustrated in FIG. 3. The handle and fastening loop are positioned at approximately the same point on the body a short distance inwardly of one body end with the handle nearest the nearest body end. The medial part of the rudder is slightly more than 90° distant from the tow rope so that when my strap is in towing position on an inner tube the rudder will be depending substantially vertically downward and there will bea solid portion of the body between handle and rudder.

Having thusly described the structure of my invention, its operation may now be understood.

Firstly a tow strap is formed according to the foregoing specification with a length of body 10 between end carried fastening devices 11 such that when the device is fastened about inner tube 31 to be serviced there will be some pneumatic and/or elastic resilience exerted upon the fastening body 10 by the serviced inner tube to bias the device to a fastened condition.

For use the device is manually placed in appropriate position, as illustrated in FIG. 1, upon well inflated pneumatic inner tube 31. The two ends of body 10 are releasably fastened to each other by appropriate manual manipulation of the particular fastening means 11 that is chosen. This manipulation may well be aided by the handle which is inwardly adjacent the fastening device defined in one end of the body. The device is then radially adjusted, if this is not already done, so that rudder 13 depends outwardly from one side surface 32 of inner tube 31, and then by reason of the construction of my device, tow rope fastening structure 14 will be pointing normally outwardly from the circular periphery of the tube and handle 12 will be extending upwardly to allow easy gripping of the handle. In this condition the device is ready for use. In use an appropriate tow rope is fastened through and to tow rope fastening structure 14 and the user mounts the tube in any desired fashion and manually grasps handle 12 to aid his positioning in or on the inner tube during towage. The device may then be towed in normal fashion.

With this arrangement of parts it is particularly to be noted that because of the elastic resilience of the inner tube, body 10 and consequently rudder 13 may be moved by manipulation of handle 12 to a slight angle to the direction of pull of a tow rope and thusly the inner tube may be steered to some degree within limits. It is further to be noted that if no steerage be had, the rudder will then tend to maintain the course of the inner tube in a straight line substantially parallel to the direction of the towage rope (not shown).

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent and what I claim is:

1. A towage strap for a pneumatically inflated inner tube, comprising, in combination:

an elongate, flexibly resilient strap-like body, formed of two pieces hingeably interconnected to aid placement; and having means at the ends thereof to releasably fasten each end to the other, the length of the body between fastening means being substantially the same as the periphery of an annular section of an inner tube to be serviced; a loop-like tow line fastening structure positioned on the body inwardly adjacent an end of the structure and extending from the surface of the body opposite that surface adjacent the serviced inner tube, to aid the fastening of a tow line thereto; and a rudder carried by the body approximately one-fourth of a body length from the loop-like fastening structure on the side of the body opposite the one adjacent the inner tube to be serviced, said rudder having some areal extension normally outwardly from the body.

2. A towage strap for a pneumatically inflated inner tube, comprising, in combination:

an elongate, flexibly resilient strap-like body, having means at the end parts thereof to releasably fasten each end to the other and having a length when fastened slightly less than the periphery of an annular section of the inner tube to be serviced;

a loop-like tow line fastening structure carried by the body inwardly adjacent one end and on the side of the body opposite to that adjacent a serviced inner tube;

a rudder carried by the body on the same surface as the tow line fastening structure and approximately one-fourth of a body length away therefrom; and a handle carried by the body, near the tow line fastening structure, to extend away from the body.

3. The invention of claim 1 further characterized by the body fastening means, comprising:

a button having a larger head and smaller shaft structurally communicating with the body immediately inwardly adjacent one end; and a cooperating slot, immediately inwardly adjacent the other end of the body, having an enlarged placement hole slightly larger than the head of the button with a smaller fastening channel, having a width slightly larger than the dimension of the button shaft, extending therefrom toward the nearest body end.

* * * * *